US011318481B2

(12) United States Patent
Glaves et al.

(10) Patent No.: US 11,318,481 B2
(45) Date of Patent: May 3, 2022

(54) DISTRIBUTOR DEVICE FOR CYCLONE SEPARATOR APPARATUS

(71) Applicant: Weir Minerals Australia Ltd, Artarmon (AU)

(72) Inventors: Garry Glaves, Marsfield (AU); Marcelo Rademacher, Lane Cove North (AU); Luis Moscoso Lavagna, North Ryde (AU)

(73) Assignee: Weir Minerals Australia Ltd.

( * ) Notice: Subject to any disclaimer, the term of this patent is extended or adjusted under 35 U.S.C. 154(b) by 0 days.

(21) Appl. No.: 16/461,737

(22) PCT Filed: Nov. 16, 2017

(86) PCT No.: PCT/AU2017/051262
§ 371 (c)(1),
(2) Date: May 16, 2019

(87) PCT Pub. No.: WO2018/090092
PCT Pub. Date: May 24, 2018

(65) Prior Publication Data

US 2019/0358652 A1 Nov. 28, 2019

(30) Foreign Application Priority Data

Nov. 17, 2016 (AU) ..... 2016904691

(51) Int. Cl.
*B04C 5/02* (2006.01)

(52) U.S. Cl.
CPC ..... *B04C 5/02* (2013.01)

(58) Field of Classification Search
CPC .... B04C 5/02; B04C 3/04; B04C 3/06; B04C 5/04; B04C 5/28
(Continued)

(56) References Cited

U.S. PATENT DOCUMENTS 3,893,922 A * 7/1975 Bobo ..... B04C 3/04 209/725
4,141,839 A * 2/1979 Niemeijer ..... B04C 5/28 210/512.2

(Continued)

FOREIGN PATENT DOCUMENTS

EP 2 868 878 5/2015
GB 2 502 640 12/2013

OTHER PUBLICATIONS

International Search Report and Written Opinion for International Application No. PCT/AU2017/051262, dated Jan. 24, 2018, 9 pages.

(Continued)

*Primary Examiner* — Claire A Norris
*Assistant Examiner* — Ekandra S. Miller-Cruz
(74) *Attorney, Agent, or Firm* — Morriss O'Bryant; Compagni Cannon, PLLC.

(57) ABSTRACT

A distributor device for use with cyclone separator apparatus, the distributor device comprising, a main body having a distribution chamber therein, the main body including a back wall and a front wall which at least in part enclose the distribution chamber, the main body including a peripheral region between the front and back walls, the device comprising a plurality of delivery outlets arranged in spaced apart relation around the peripheral region the front wall having an inner face and a back wall having an inner face, the device further including a feed inlet to the distribution chamber in the front wall having a main axis extending in a direction between the front and back walls; the back wall having an inner face which includes main face section and a protrusion which extends from the main face section towards the inner face of the front wall.

9 Claims, 7 Drawing Sheets

(58) Field of Classification Search
USPC ..... 210/512.1
See application file for complete search history.

(56) References Cited

U.S. PATENT DOCUMENTS

| | | | | |
|---|---|---|---|---|
| 6,958,107 | B1 * | 10/2005 | Clarke | B04C 3/06 159/2.1 |
| 7,935,162 | B2 * | 5/2011 | Hyun | A47L 9/1633 55/343 |
| 9,016,480 | B2 * | 4/2015 | Tandon | B04C 5/28 209/711 |
| 2004/0250374 | A1 * | 12/2004 | Park | B04C 9/00 15/353 |
| 2007/0144116 | A1 | 6/2007 | Hong et al. | |
| 2013/0118960 | A1 | 5/2013 | Tandon | |
| 2015/0257617 | A1 * | 9/2015 | Marsden | A47L 9/1641 55/343 |

OTHER PUBLICATIONS

International Preliminary Report on Patentability for Application No. PCT/AU2017/051262, dated Mar. 14, 2019, 9 pages.
European Patent Application No. 17871157.8, Extended European Search Report, dated Jun. 18, 2020, 8 pgs.

* cited by examiner

DISTRIBUTOR DEVICE FOR CYCLONE SEPARATOR APPARATUS

CROSS-REFERENCE TO RELATED APPLICATIONS

This application is a 371 U.S. National Stage Application of International Application No. PCT/AU2017/051262, filed Nov. 16, 2017, which claims priority to Australian Application No. 2016904691, filed Nov. 17, 2016, which are incorporated herein by reference in their entireties.

TECHNICAL FIELD

This disclosure relates generally to cyclone separator apparatus and more particularly to components associated with such apparatus. More particularly, but not exclusively the disclosure is concerned with cyclone separator apparatus for use in the mineral and chemical processing industries.

BACKGROUND ART

Cyclone separators such as hydrocyclones can be used, for example, for separating suspended matter from a flowing liquid such as a mineral slurry by generating centrifugal forces within the hydrocyclone as the liquid passes through a conical shaped separating chamber. Basically, hydrocyclones include (a) a feed chamber, (b) the above mentioned conical separating chamber which is downstream of the feed chamber, (c) a feed inlet which is usually generally tangential to the axis of the feed chamber and is disposed at the end of the chamber of greatest cross-sectional dimension, (d) an underflow outlet at the smaller cross-sectional end of the chamber and (e) an overflow outlet at the larger cross-sectional end of the chamber. The feed chamber inlet is arranged to deliver the liquid containing suspended matter into the hydrocyclone and when in operation, the arrangement is such that the heavy matter tends to migrate towards the wall of the chamber and towards and out through the underflow outlet. Finer material migrates towards the central axis of the chamber and towards and out via the overflow outlet. Hydrocyclones can be used for size separation of a suspended solid particles, for example, in a particulate slurry, or for particle density separation.

In some processing installations, in order to improve flow throughput and efficiency, a number of cyclone separators are arranged in what is commonly referred to as a cyclone cluster. The cyclone separators are mounted to a support frame and are generally radially disposed from a central axis of the support frame. The cyclone separators are adapted to receive a fluid to be processed from a common inlet source and that fluid is fed to the feed chamber inlet of each cyclone separator via a distributor device so that the cyclone separators are arranged in a parallel flow circuit. A typical installation is illustrated in FIGS. 1 and 2, which as stated above, is often referred to as a cyclone cluster. With reference to FIGS. 1 and 2 there is shown an installation 100 which includes a support frame 102 to which a plurality of cyclone separators 104 are mounted. The installation 100 includes a delivery line 106 for delivering material to a distributor or manifold 108, the inlet to each cyclone separator being operatively connected to the distributor or manifold 108. The overflow outlet from each cyclone separator is in fluid communication with collection vessel 110, and the underflow outlet for each cyclone separator is in fluid communication with a collection vessel 112.

Currently known cyclone clusters, such as for example the distributor 108 shown in FIG. 2, can be subject to relatively high erosion because of the flow path of particulates through the distributor. Conventional distributor devices are in essence in the form of a flat tank with flat front and back walls. In use the distributor is orientated with the back wall being above the front wall and the inlet is in the front wall and directs incoming fluid towards the back wall. The pump delivering the fluid causes the fluid entering the distributor to generate a strong recirculation flow pattern which results in significant losses and erosion within the distributor.

SUMMARY OF THE DISCLOSURE

In a first aspect, embodiments are disclosed of a distributor device for use with cyclone separator apparatus, the distributor device comprising, a main body having a distribution chamber therein, the main body including a back wall and a front wall which at least in part enclose the distribution chamber, the front and back walls each having an inner face, the main body including a peripheral region between the front and back walls, the device further comprising a plurality of delivery outlets arranged in spaced apart relation around the peripheral region, the device further including a feed inlet to the distribution chamber in the front wall, the feed inlet having a main axis extending in a direction between the front and back walls; the back wall inner face including a main face section and a protrusion which extends from the main face section towards the inner face of the front wall.

In certain embodiments, the protrusion has a curved profile including curved side regions and a curved apex region remote from the main face section. In certain embodiments, the apex region has a central part which is in line with the main axis of the feed inlet.

In certain embodiments, the inlet comprises an inlet passage which includes an outer section which is generally cylindrical in cross section and an inner section which is flared outwardly in cross section from the outer section in the direction of the front wall. In certain embodiments, the flared inner section is curved. In certain embodiments, the flared section blends into the inner surface of the front wall providing a continuous surface. In certain embodiments, the inner face of the front wall and the inner face of the back wall are substantially parallel in the region of the main face section of the back wall.

In certain embodiments, the peripheral region includes a side wall the delivery outlets being formed in or connected to the side wall. In certain embodiments, adjacent delivery outlets are arranged in close proximity to one another with a junction region between adjacent delivery outlets. In certain embodiments, the junction regions have a curved leading edge portion with respect to the direction of flow through the delivery outlets. In certain embodiments, each delivery outlet has a delivery passageway configured so as to increase the discharge speed from the distribution chamber. In certain embodiments, each delivery outlet comprises a tapering passageway and may, for example be in the form of a nozzle.

In a second aspect, embodiments are disclosed of a cyclone separator apparatus comprising a support frame, a plurality of cyclone separators mounted to the support frame and radially disposed above a main axis of the support frame, a delivery line for delivering material to a distributor or manifold, as described above, each cyclone separator being operatively connected to the distributor or manifold.

Other aspects, features, and advantages will become apparent from the following detailed description when taken in conjunction with the accompanying drawings, which are a part of this disclosure and which illustrate, by way of example, principles of inventions disclosed.

DESCRIPTION OF THE FIGURES

The accompanying drawings facilitate an understanding of the various embodiments.

DETAILED DESCRIPTION

Figure 1:
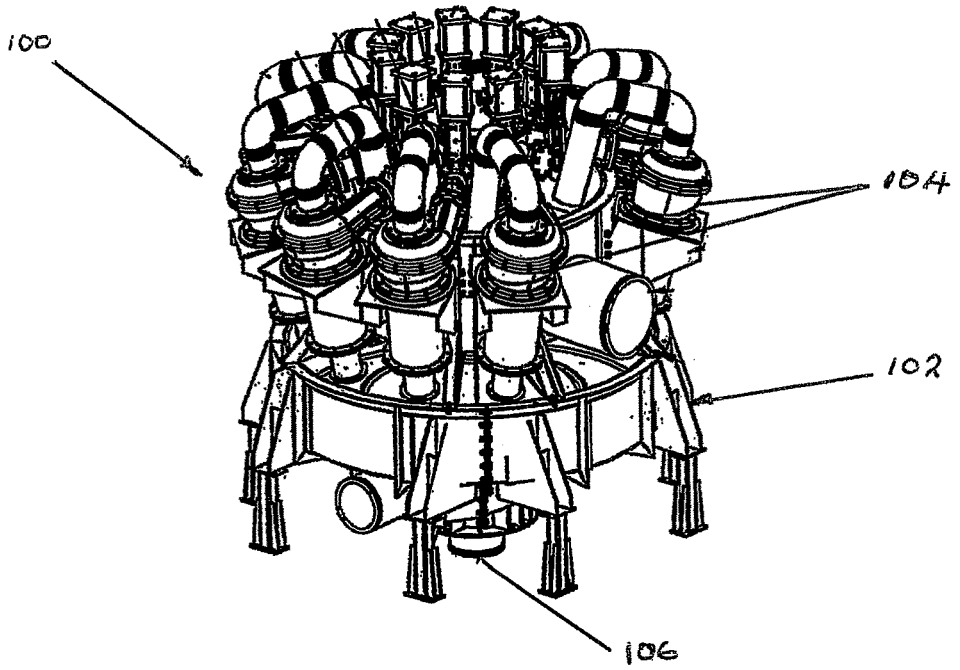
FIG. 1 (PRIOR ART)
FIG. 1 is an isometric view of a conventional cyclone separator apparatus.
Figure 2:
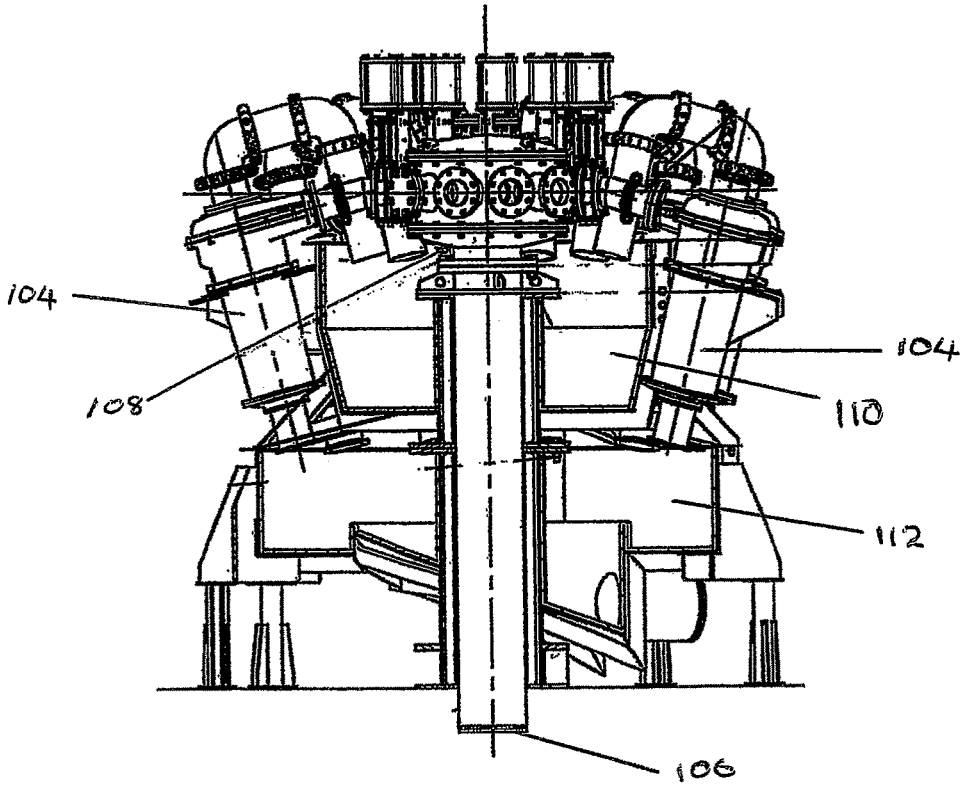
FIG. 2 (PRIOR ART)
FIG. 2 is a part sectional view of the apparatus shown in FIG. 1.
Figure 3:
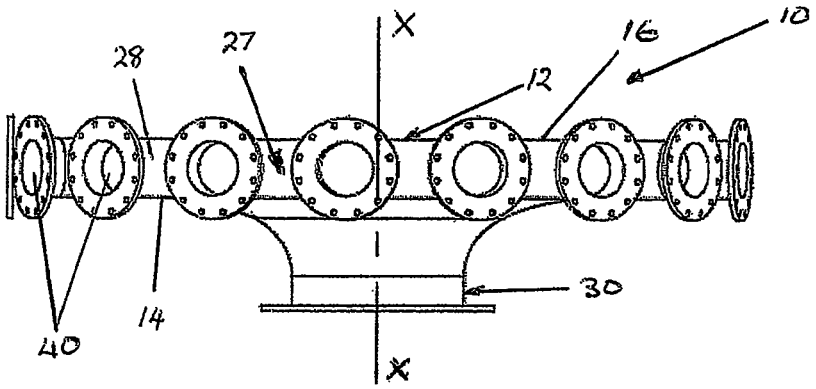
FIG. 3 is a schematic side elevation of a distributor device according to one embodiment of the present disclosure.
Figure 4:
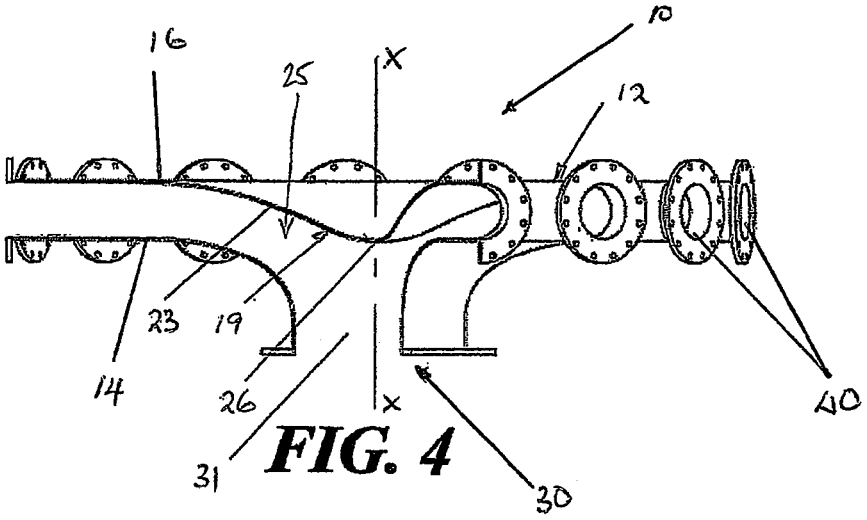
FIG. 4 is a partially cut away view of the device shown in FIG. 3.
Figure 5:
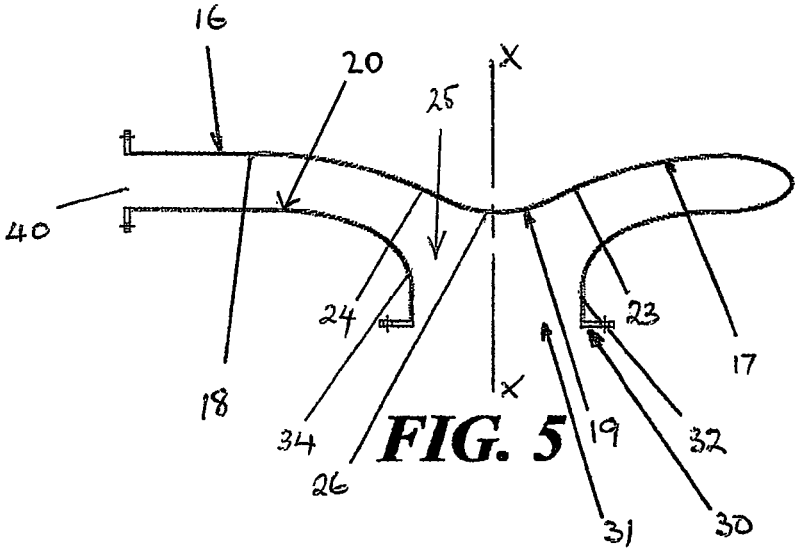
FIG. 5 is a schematic illustration of the flow passage within the device shown in FIGS. 3 and 4.

Referring to FIGS. 3 to 6, there is illustrated a distributor device 10 for use in cyclone separator apparatus of the type illustrated in FIGS. 1 and 2. The distributor device 10 is adapted for use in installations of the type shown in FIGS. 1 and 2 and replaces the distributor or manifold 108.

The distributor device 10 comprises a main body 12 with a distribution chamber 25 therein. The main body 12 includes a front wall 14 and a back wall 16 which at least partially enclose the distribution chamber 25. The main body further includes an outer peripheral portion 27 between the front and back walls 14 and 16 and at peripheral edges thereof. The peripheral portion 27 comprises an outer peripheral side wall 28. The distributor device is generally circular when viewed in plan and when installed, the back wall 16 is disposed above the front wall 14.

Figure 6:
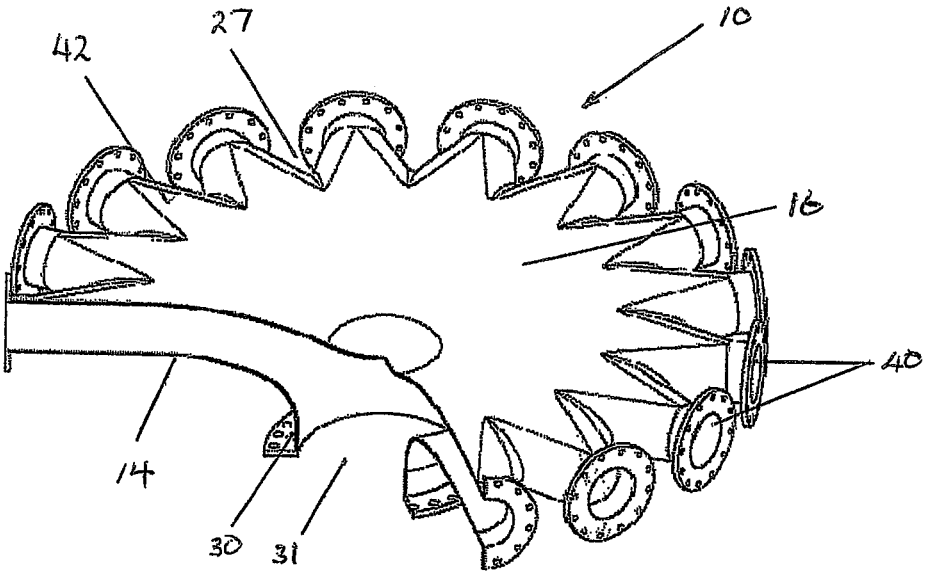
FIG. 6 is a partially cut away isometric view of the device shown in FIGS. 3 to 5.
Figure 7:
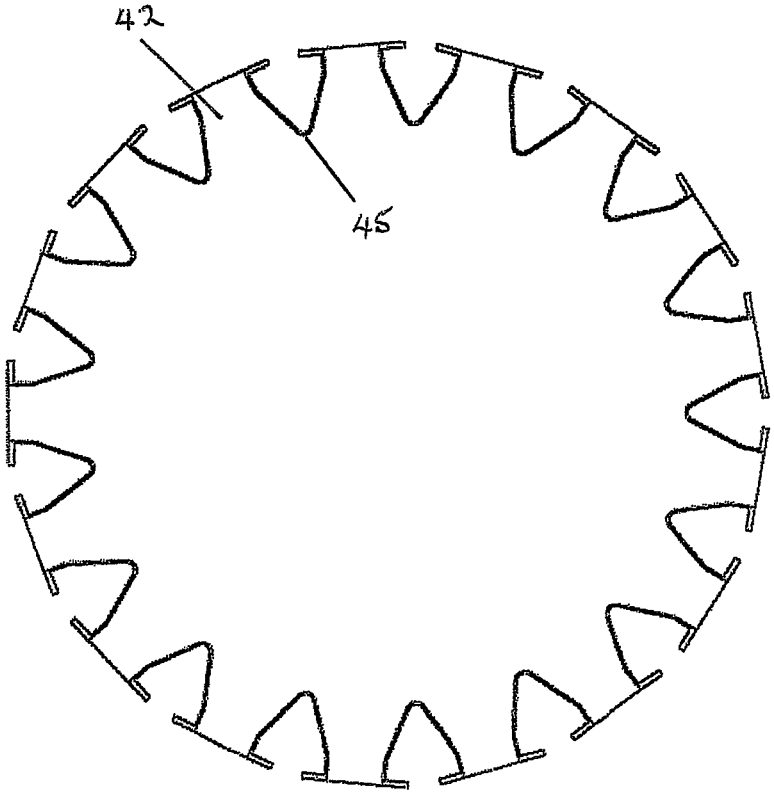
FIG. 7 is a schematic plan view specifically illustrating the arrangement of the delivery outlets.

The device 10 further includes a feed inlet 30 for delivering material to be processed to the distribution chamber 25, and a plurality of delivery outlets 40 disposed in spaced apart relation around the peripheral portion 27. The delivery outlets 40 are configured so as to increase the speed of fluid discharge from the distribution chamber 25. To this end, the delivery outlets may have a passageway which tapers or reduces in cross sectional dimension in the direction of flow. For example, the delivery outlets 40 may be in the form of nozzles 42 which extend through the side wall 28. Each nozzle 42 is operatively connected to a respective inlet of the cyclone separators in a similar fashion as shown in FIGS. 1 and 2. The nozzles 42 are connected to, or form part of, the side wall 28. In one form, the side wall 28 and nozzles 42 form a manifold unit to which the front and back walls can be connected. As best seen in FIG. 6, adjacent nozzles 42 are arranged in close proximity to one another with a junction region 45 therebetween. The junction region 45 has a curved profile.

The back wall 16 has an inner face 17 which includes a main face section 18 which is generally planar and at right angles to the axis X-X. The inner face 17 further includes a protrusion 19 which extends from the main face section 18 towards the front wall 14. The protrusion 19 has a curved profile including curved side portions 23 and 24 and a curved apex portion 26 which is aligned with axis X-X. When installed, the axis X-X is generally upright or vertical with the back wall 16 being disposed above the front wall 14.

The inlet 30 has an inlet passage 31 which has an outer section 32 having a generally cylindrical inner surface, and an inner section 34 having a flared inner surface which blends into an front wall inner face 20. The flared inner section 34 leading from the outer section 32 may be flared whereby it may be referred to as trumpet shaped or bell shaped. The arrangement is such that the inner surface of the outer section 32, the flared inner section 34, the front wall inner face 20 and the outlets 40 form a continuous uninterrupted blended surface leading from the inlet passage to the outlets 40. The front wall inner face 20 leading from the flared inner section 34 may be general parallel to, or generally equidistant, from the back wall inner face 17 in the area of the distribution chamber 25 beginning at the curved side portions 23, 24 and leading to the outlets 40.

It is believed the configuration of the inner face 17 of the back wall 16 of the distribution chamber 25, preferably taken in conjunction with the configuration of the inlet 30, flared inner section 34 and front wall inner face 20 will substantially contribute to reducing erosion within the distribution device 10. The protrusion 19 on the inner face 17 will tend to split the incoming fluid flow and redirect it towards the delivery outlets 40. The curved configuration of the inlet passage 31 is also believed to minimise fluid separation from the walls 14, 16 as it is directed towards the delivery outlets 40; that is there will be less likelihood of detached vortices forming minimising turbulence and recirculation.

Experimental Simulation

Computational experiments were carried out to simulate flow patterns in the various designs of distributor, using commercial software ANSYS CFX. This software applies Computational Fluid Dynamics (CFD) methods to solve the velocity field for the fluid being pumped. The software is capable of solving many other variables of interest however velocity is the variable which is relevant for the figures shown herein.

Figure 8:
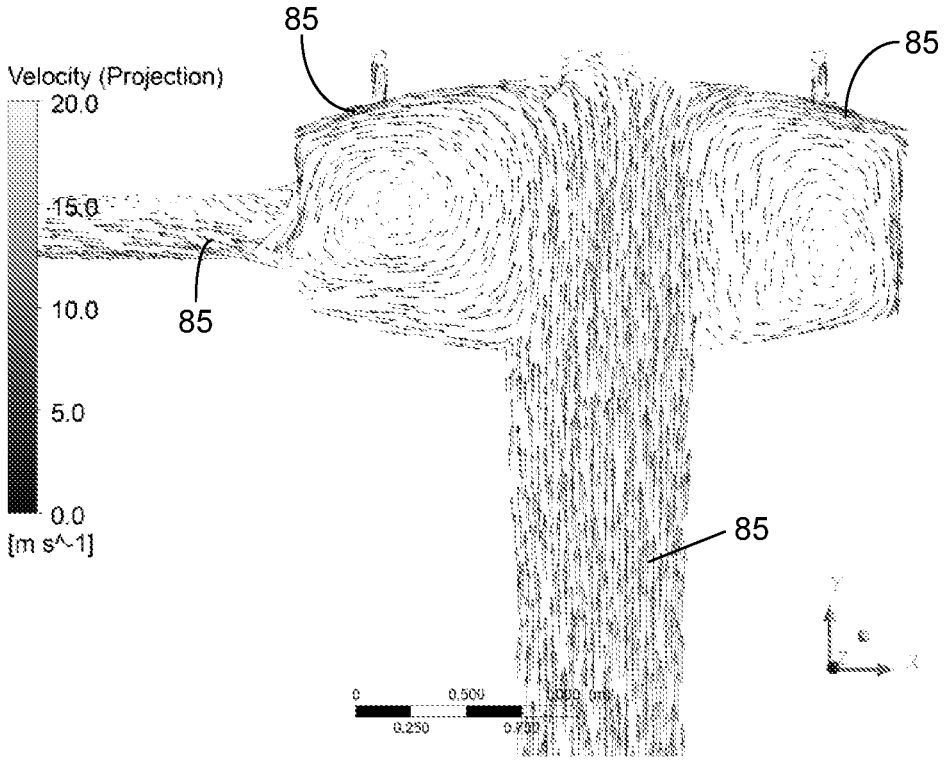
FIG. 8 is cross-sectional view of conventional distributor device depicting CFD velocity vectors of a fluid passing through the device.
Figure 9:
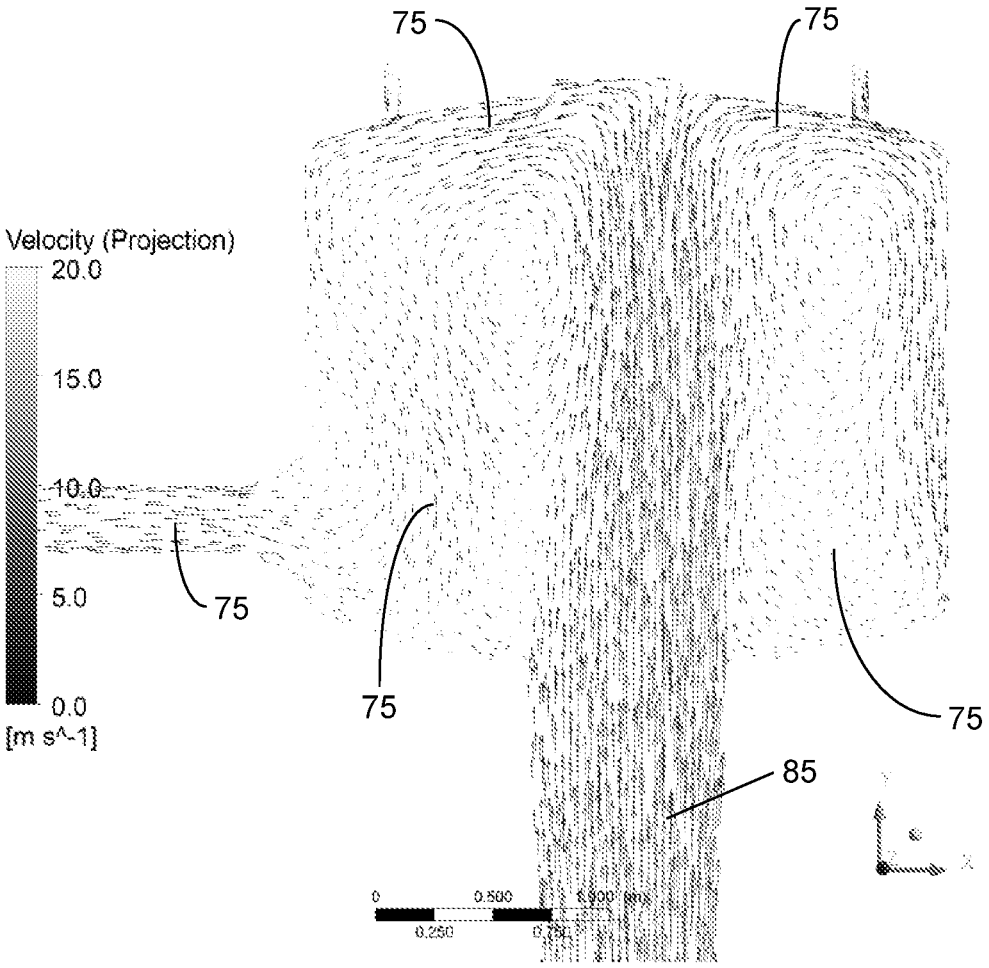
FIG. 9 is a cross-sectional view of a modified conventional distributor device depicting CFD velocity vectors of a fluid passing through the device.
Figure 10:
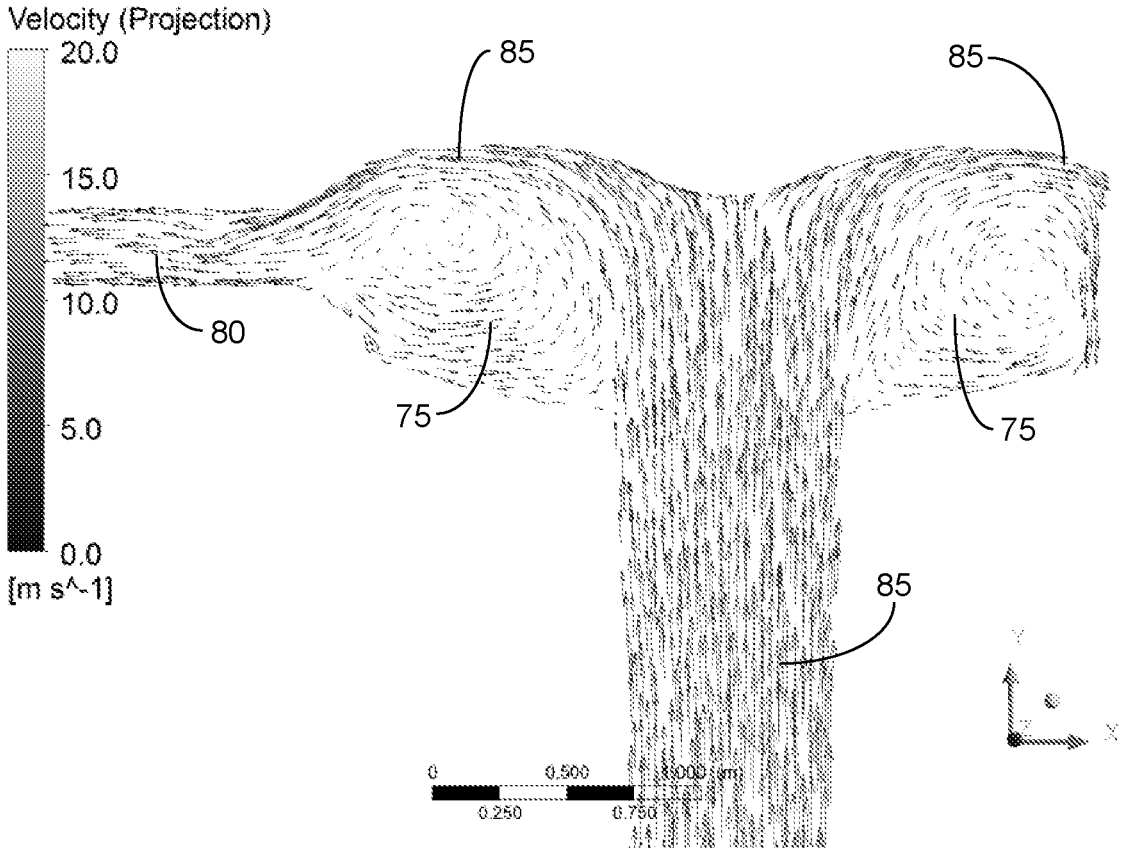
FIG. 10 is a cross-sectional view of a distributor device in accordance with one embodiment of the present disclosure depicting CFD vectors of a fluid passing through the device; and, FIG. 11 is a cross-sectional view of a distributor device in accordance with another embodiment of the present disclosure depicting CFD vectors of a fluid passing through the device.
Figure 11:
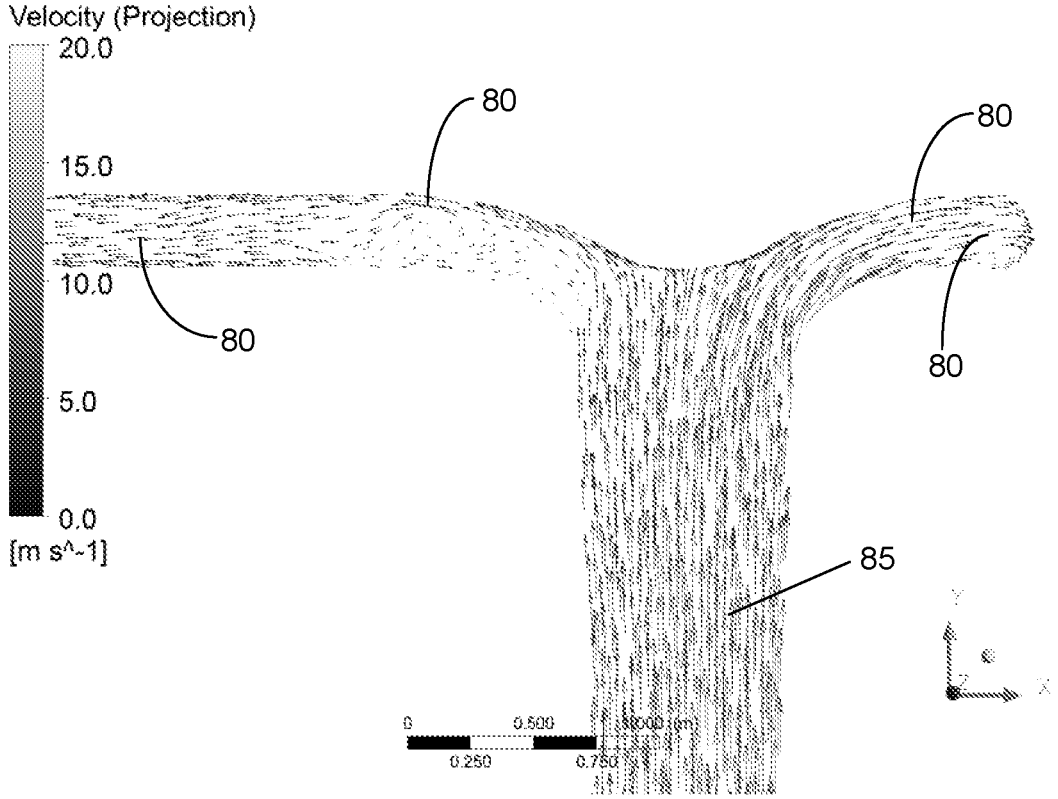

For each CFD experiment, the results are post-processed using the corresponding module of CFX. FIGS. 8 to 10 each show a cross-sectional view of different distributor devices. The velocity vectors are plotted to analyse how the fluid and the slurry particles move through the distributor devices.

Case 1

This relates to a conventional distributor device, such as for example shown in FIGS. 1 and 2. FIG. 8 illustrates various vector velocities of the fluid and particulates entering the distribution chamber, flowing through the chamber and out of the delivery outlets. The fluid enters the chamber at relatively high velocity 85. The flow continues towards the back wall of the distributor where in the region of the back wall it tends to accelerate and disperse towards the delivery outlets, resulting in a region of high velocity 85 at the back wall. This results in a large degree of turbulence within the chamber which is believed to cause significant wear in the region of the back wall and delivery outlets.

Case 2

This relates to a modified conventional distributor device having a distribution chamber which has an increased height or distance between the front and back walls relative to that shown in Case 1 and therefore has a larger distribution chamber. As can be seen from FIG. 9, entry to the chamber in this case is substantially the same as for Case 1 with relatively high velocity fluid 85, but because of the increased distance between the front and back walls of the chamber, the fluid decelerates to a relatively low velocity 75 prior to reaching the back wall, thereby reducing the turbulence within the chamber. Because of the size of the chamber, significant losses in fluid velocity at the delivery outlets occur because of recirculation therewithin.

Case 3

This relates to a distribution device in accordance with the present disclosure having a back wall with a protrusion as previously described. FIG. 10 demonstrates the effect of the protrusion being to redirect the relatively high velocity fluid 85 entering the chamber down to a medium flow rate 80 at the back wall, and at same time to reduce turbulence and recirculation losses, and while maintaining a medium velocity 80 flow at the delivery outlets.

Case 4

This relates to a distribution device in accordance with the present disclosure having a back wall as described in Case 3 together with a front wall and inlet as herein described. The effect of the protrusion and inlet configuration further reduces turbulence and recirculation losses and maintains a medium velocity flow 80 at the delivery outlets.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Table of Parts

| | |
|---|---|
| Installation | 100 |
| Support Frame | 102 |
| Cyclone Separators | 104 |
| Delivery Line | 106 |
| Distributor/Manifold | 108 |
| Collection Vessel | 110 |
| Collection Vessel | 112 |
| Distributor Device | 10 |
| Main Body | 12 |
| Distribution Chamber | 25 |
| Front Wall | 14 |
| Back Wall | 16 |
| Outer Peripheral Portion | 27 |
| Outer Peripheral Side Wall | 28 |
| Feed Inlet | 30 |
| Delivery Outlets | 40 |
| Nozzles | 42 |
| Back Wall Inner Face | 17 |
| Front Wall Inner Face | 20 |
| Main Face Section | 18 |
| Protrusion | 19 |
| Curved Side Portions | 23/24 |
| Apex Portion | 26 |
| Inlet Passage | 31 |
| Outer Section | 32 |
| Inner Section | 34 |
| Junction Region | 45 |
| Low Velocity | 75 |
| Medium Velocity | 80 |
| High Velocity | 85 |

The invention claimed is:

1. A distributor device for use with cyclone separator apparatus, the distributor device comprising, a main body having a distribution chamber therein, the main body including a back wall and a front wall which at least in part enclose the distribution chamber, the main body including a peripheral region between and surrounding the front and back walls to define a side wall, the device comprising a plurality of delivery outlets arranged in spaced apart relation in and around the side wall of the peripheral region, the front wall having an inner face and the back wall having an inner face, the device further including a feed inlet to the distribution chamber in the front wall having a main axis extending in a direction between the front and back walls; the inner face of the back wall including a main face section and a protrusion which extends from the main face section towards the inner face of the front wall, wherein the feed inlet comprises an inlet passage which includes an outer section which is cylindrical in cross section and an inner section which is flared outwardly in cross section from the outer section in the direction of the front wall, wherein the flared inner section is curved in a trumpet shape, wherein the flared inner section blends into the inner face of the front wall providing a continuous uninterrupted blended surface leading from the inlet passage to the delivery outlets to deliver fluid to a point at the peripheral region of the main body, wherein the inner face of the front wall and the inner face of the back wall are substantially parallel in a region of the main face section of the back wall.

2. The distributor device according to claim 1, wherein the protrusion has a curved profile including (i) curved side regions, wherein the curved side regions extend inwardly into the distribution chamber from the main face section of the back wall and toward the inner face of the front wall, and (ii) a curved apex region remote from the main face section and disposed at a position between both the back wall and the front wall and at least partially encircled by the peripheral region.

3. The distributor device according to claim 2, wherein the apex region has a central part which is in line with the main axis of the feed inlet.

4. The distributor device according to claim 1, wherein each delivery outlet has a delivery passageway terminating with an aperture at the peripheral region and configured so as to increase discharge speed from the distribution chamber.

5. The distributor device according to claim 4, wherein each delivery passageway is tapered inwardly from an inner end adjacent the distribution chamber towards an outer end and defines at least a portion of the aperture that is through the peripheral region and extending from the back wall to the front wall.

6. The distributor device according to claim 5, wherein the delivery outlets comprise nozzles.

7. The distributor device according to claim 4, wherein adjacent delivery outlets are arranged in close proximity to one another with a junction region therebetween, each junction region having a curved leading edge portion with respect to a direction of flow through the delivery outlets.

8. A cyclone separator apparatus comprising a support frame, a plurality of cyclone separators mounted to the support frame and radially disposed above a main axis of the support frame, a delivery line for delivering material to a distributor device or manifold that includes: a main body having a distribution chamber therein, the main body including a back wall and a front wall which at least in part enclose the distribution chamber, the main body including a peripheral region between the front and back walls defining a peripheral side wall, the device comprising a plurality of delivery outlets arranged in spaced apart relation around the peripheral side wall, the front wall having an inner face and the back wall having an inner face, the device further including a feed inlet to the distribution chamber in the front wall having a main axis extending in a direction between the front and back walls; the inner face of the back wall including a main face section and a protrusion which extends from the main face section towards the inner face of the front wall, wherein each cyclone separator being operatively connected to the distributor device or manifold, wherein the feed inlet comprises an inlet passage which includes an outer section which is cylindrical in cross section and a flared inner section comprising a trumpet shape and which is flared outwardly in cross section from the outer section in the direction of the front wall, wherein the flared inner section is curved, wherein the flared inner section blends into the inner face of the front wall providing a continuous uninterrupted blended surface leading from the inlet passage to the delivery outlets, and wherein the inner face of the front wall and the inner face of the back wall are substantially parallel in a region of the main face section of the back wall.

9. A distributor device for use with cyclone separator apparatus, the distributor device comprising: a main body having a distribution chamber therein and comprising: a back wall having a back wall inner face; a front wall having a front wall inner face, wherein the back wall and the front wall at least in part enclose the distribution chamber, and a peripheral region positioned between and surrounding the front wall and the back wall to define a side wall at the peripheral region; a plurality of delivery outlets positioned adjacent to both the front wall and the back wall and arranged in spaced apart relation along the side wall of the peripheral region to deliver fluid to a point at the peripheral region of the distributor device proximate the side wall, wherein the delivery outlets are formed in or connected to the side wall; a feed inlet to the distribution chamber in the front wall having a main axis extending in a direction between the front and back walls, wherein the back wall inner face includes a main face section and a protrusion which extends from the main face section towards the front wall inner face, wherein the feed inlet comprises an inlet passage which includes an outer section which is cylindrical in cross section and an inner section which is flared in a trumpet shape and outwardly in cross section from the outer section in the direction of the front wall, wherein the flared inner section is curved, wherein the flared inner section blends into the front wall inner face providing a continuous uninterrupted blended surface leading from the inlet passage to the delivery outlets, wherein the front wall inner face and the back wall inner face are substantially parallel in a region of the main face section of the back wall inner face.

* * * * *